US007051412B2

(12) United States Patent
Hurtado, Jr.

(10) Patent No.: US 7,051,412 B2
(45) Date of Patent: May 30, 2006

(54) UNIVERSAL JOINT TOOL

(76) Inventor: Miguel Hurtado, Jr., 102 Castroville Rd., San Antonio, TX (US) 78207

( * ) Notice: Subject to any disclaimer, the term of this patent is extended or adjusted under 35 U.S.C. 154(b) by 0 days.

(21) Appl. No.: 10/882,209

(22) Filed: Jul. 2, 2004

(65) Prior Publication Data

US 2006/0016057 A1 Jan. 26, 2006

(51) Int. Cl.
*B25B 27/14* (2006.01)

(52) U.S. Cl. ..... 29/281.1

(58) Field of Classification Search ..... 29/281.1; 269/311–314, 43, 69
See application file for complete search history.

(56) References Cited

U.S. PATENT DOCUMENTS 3,230,617 A 1/1966 Spiess et al.
3,359,618 A 12/1967 Murphy
3,610,612 A * 10/1971 Day ..... 269/69
3,786,544 A 1/1974 Ferguson
4,343,075 A 8/1982 Guptill et al.
4,558,502 A 12/1985 Gossmann et al.
4,854,568 A * 8/1989 Baeza et al. ..... 269/268
4,977,660 A 12/1990 Maynard
5,330,167 A * 7/1994 Plumb ..... 269/43
6,364,277 B1 * 4/2002 Miller ..... 248/676
6,681,464 B1 * 1/2004 Dupuis et al. ..... 29/281.1

* cited by examiner

*Primary Examiner*—Lee D Wilson
(74) *Attorney, Agent, or Firm*—Stephen R. Greiner

(57) ABSTRACT

A tool for removing universal joints from driveshafts of land vehicles and other devices. The tool includes a pair of retaining blocks with notches for supporting a universal joint in a hydraulic press. The notches are shaped to accommodate driveshafts of different configurations and tabs at the bottom of the notches stop the fall of a driveshaft in the event that such become detached from a universal joint.

1 Claim, 2 Drawing Sheets

UNIVERSAL JOINT TOOL

FIELD OF THE INVENTION

The present invention relates generally to metal working implements having means to assemble or disassemble.

BACKGROUND OF THE INVENTION

Removing a universal joint from the driveshaft has never been an easy task for a mechanic. Traditional methods called for the application of heat and the business end of a hammer to driveshaft yokes. Often, the yokes were damaged beyond repair. It was also not unusual to permanently damage a universal joint or its bearing cups with blows of a hammer.

To overcome some of the problems associated with brute force methods for handling universal joints, many mechanics have taken to using hydraulic presses to separate driveshaft yokes from the bearing cups of universal joints. The use of hydraulic presses eliminated dangerous heating and hammering and was found to be relatively quick. However, the misalignment and movement of universal joints in presses often resulted in bent yokes and driveshafts.

SUMMARY OF THE INVENTION

In light of the problems associated with the known methods and apparatus for removing universal joints from driveshafts, it is a principal object of the invention to provide a tool that firmly supports a universal joint in a hydraulic press. The tool effectively eliminates misalignments and inadvertent damage to universal joints, bearing cups, yokes and driveshafts.

It is a further object of the present invention to provide a universal joint tool of the type described that can be adjusted to accommodate universal joints, yokes and driveshafts used with all known trucks, tractors, automobiles, airplanes, boats and heavy-duty machinery. The tool can be employed to selectively remove a conventional universal joint from a driveshaft in minutes.

It is another object of the invention to provide a universal joint tool of the type described that has an uncomplicated construction and requires no additional tools (other than a hydraulic press) to set up and use. No fasteners, cables or adapters are required.

It is an additional object of the invention to provide a tool of the type described that can be used with a hydraulic press to dismantle front wheel drive assemblies and remove hubs from water pumps. In short, the tool can remove and install: bearings, bushings, gears and myriad other objects that are press-fit upon a carrier.

It is an object of the invention to provide improved elements and arrangements thereof in a universal joint tool for the purposes described that is lightweight in construction, inexpensive to manufacture, durable, and dependable in use.

Briefly, the tool in accordance with this invention achieves the intended objects by featuring a pair of retaining blocks positioned adjacent one another. Each of the blocks includes a front wall having a "stair step" configuration with a forward wall segment being connected to a rearward wall segment by an intermediate wall segment. A retaining tab extends forwardly from the bottom of the rearward wall segment. A top wall extends rearwardly from the top of the front wall. A bottom wall extends rearwardly from the bottom of the front wall. A pair of side walls extends rearwardly from the opposed ends of the front wall and connects the top wall and the bottom wall together.

The tool in accordance with this invention also features a pair of semicircular notches in each of the blocks that assist in pressing bearings, gears, and other objects from an axle, shaft or tube.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
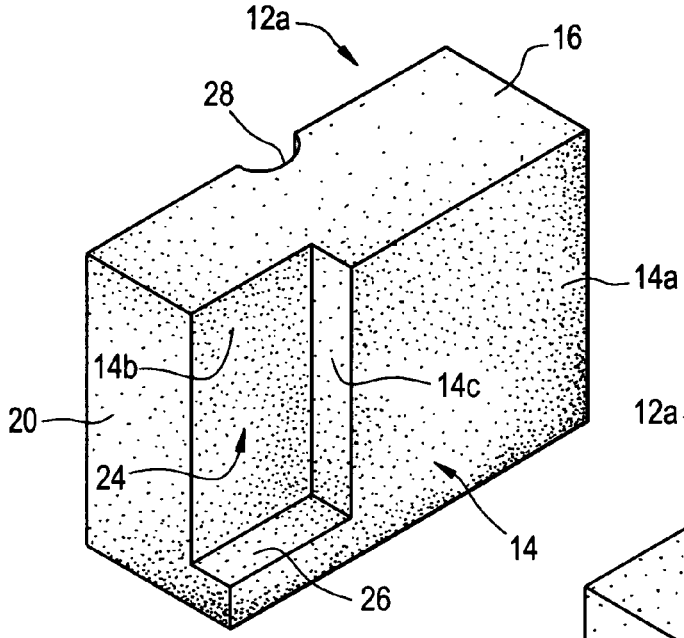
FIG. 1 is a front perspective view of a retaining block forming a portion of a universal joint tool in accordance with the present invention.
Figure 2:
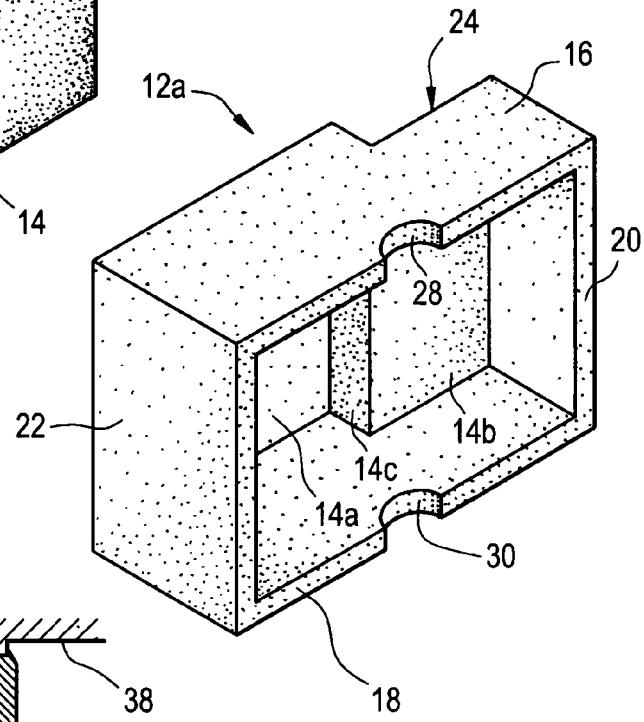
FIG. 2 is a rear perspective view of the retaining block of FIG. 1.

Referring now to the FIGS., a universal joint tool in accordance with the present invention is shown at 10. Tool 10 includes a pair of retaining blocks 12*a* and 12*b* that are mirror images and are positioned adjacent one another during normal use. Each of blocks 12*a* and 12*b* includes a rectangular front wall 14 with a top wall 16 extending rearwardly from the top of front wall 14 and a bottom wall 18 extending rearwardly from the bottom of front wall 14. From the opposite ends of front wall 14, a pair of side walls 20 and 22 extend rearwardly and connect top wall 16 and bottom wall 18 together. Thus, each block 12*a* and 12*b* is configured like a box with an open back.

Front wall 14 has a "stair step" configuration that provides a rectangular recess 24 at one end of each of blocks 12*a* and 12*b*. Here, front wall 14 includes a forward wall segment 14*a* and a rearward wall segment 14*b* connected together by an intermediate wall segment 14*c*. Wall segments 14*a* and 14*b* are positioned in parallel planes with wall segment 14*b* being rearwardly offset. Wall segment 14*c* is in a plane oriented at right angles to those containing wall segments 14*a* and 14*b* and connects the inner ends of wall segments 14*a* and 14*b*.

At the bottom of recess 24, a retaining tab 26 that is rectangular in outline projects forwardly from wall segment 14*b*. Tab 26 has a length equal to that of wall segment 14*b* and a width equal to that of wall segment 14*c* and is joined to both. For convenience in constructing blocks 12*a* and 12*b*, tab 26 is integrally formed with bottom wall 18.

Top wall 16 and bottom wall 18 are respectively provided with notches 28 and 30 along their rearward edges. Notches 28 and 30 are semicircular in outline and are vertically aligned so as to snugly accommodate portions of an axle 32 as will be described below. The radius of curvature of notches 28 and 30 can be varied to accommodate axles of different diameters.

Walls 14–22 are constructed from metal plates of even thickness. Walls 14–22 can be joined together by any suitable method including welding and casting as an integral whole. Regardless, walls 14–22 should have a thickness sufficient to bear expected loads provided by a hydraulic press 34 including a fixed base 36 and an extensible ram 38. Preferably, ram 38 carries a cylindrical foot 40 adapted to press against, and selectively receive therein, any one of the bearing cups 42 and 44 of a universal joint 46 supported by tool 10.

Figure 3:
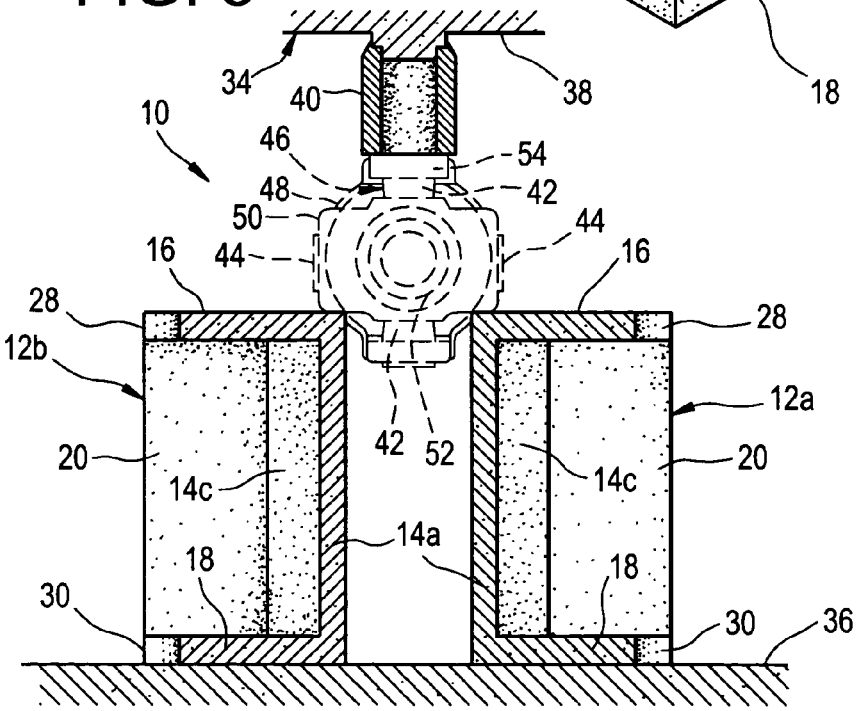
FIG. 3 is a side view of the universal joint tool in a first position supporting a universal joint and driveshaft in a hydraulic press with portions of the tool and press being broken away to reveal details thereof.
Figure 4:
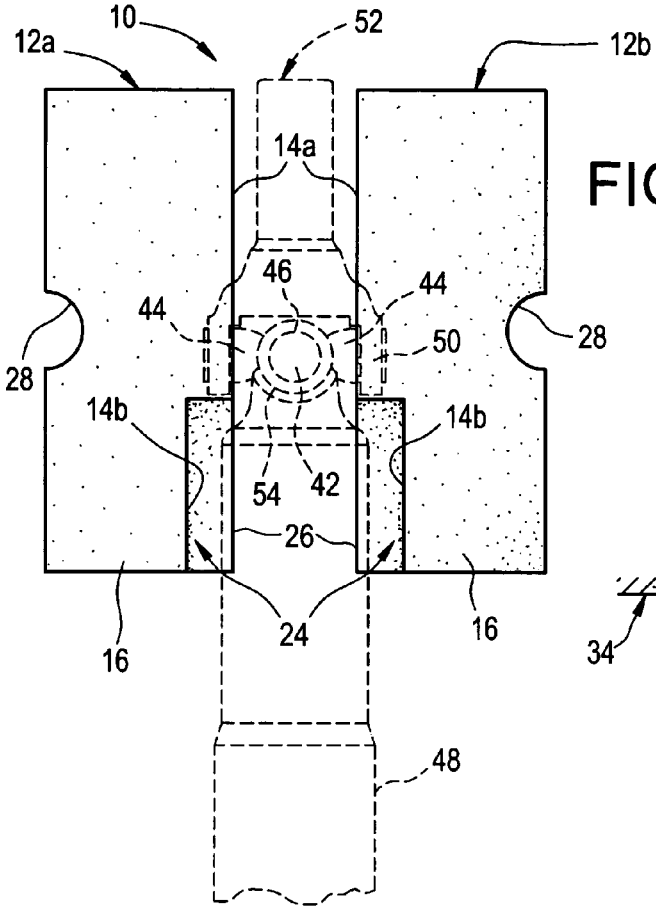
FIG. 4 is a top view of the universal joint tool supporting the universal joint and driveshaft of FIG. 3.

Use of tool 10 to remove universal joint 46 from a driveshaft 48 is straightforward. First, as shown in FIGS. 3–4, blocks 12*a* and 12*b* are positioned on base 36 of hydraulic press 34 with front walls 14 facing one another. Next, driveshaft connector yoke 50 is positioned atop blocks 12*a* and 12*b* with driveshaft connector yoke stem 52 extending between wall segments 14*a* and relatively wide driveshaft 48 extending into notches 24 between wall segments 14*b*. Foot 40 of press 34 is, then, lowered onto driveshaft yoke 54, pushing yoke 54 downwardly and freeing a first pair of bearing cups 42 of universal joint 46 from yoke 54. With cups 42 free, yoke 54 is pulled away from driveshaft 48. Finally, driveshaft 48 is rotated 90° and foot 40 is engaged with driveshaft connector yoke 50 to push yoke 50 downwardly and free a second pair of bearing cups 44 of universal joint 46 from yoke 50. The entire process of detaching universal joint 46 from driveshaft 48 is performed easily and in complete safety with retaining tabs 26 serving to stop the downward motion of driveshaft 48 in the event that it becomes unexpectedly detached from yoke 50. Should it be desired that a new universal joint be installed upon driveshaft 48, the steps outlined for detachment need only be reversed.

Figure 5:
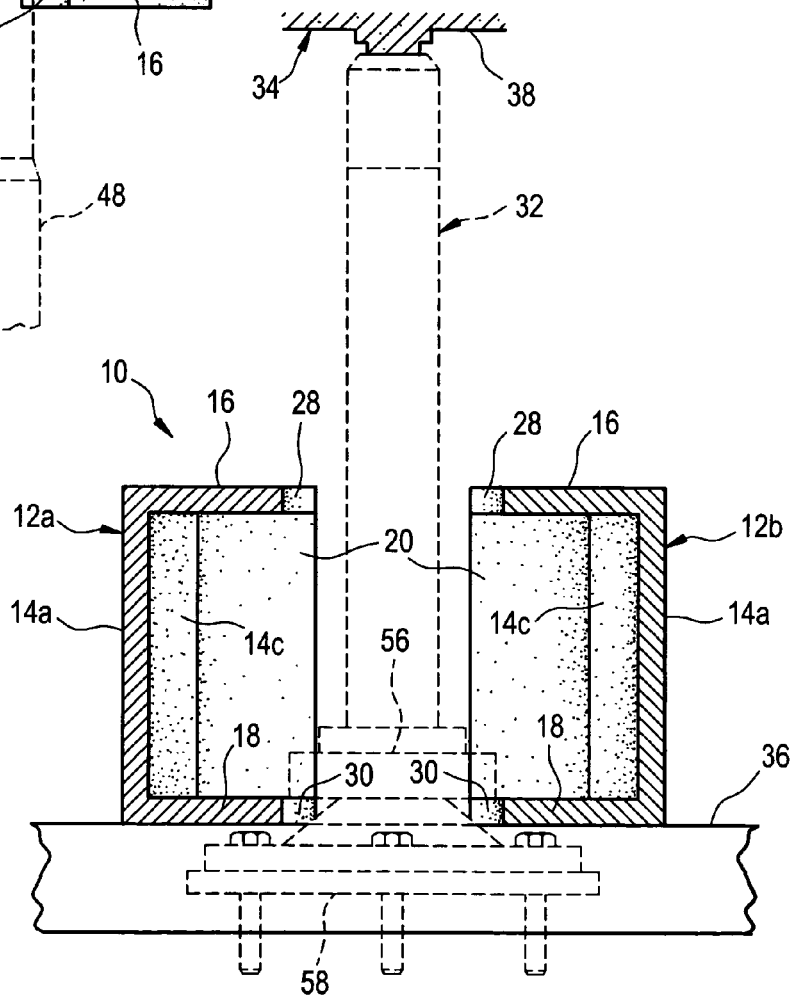
FIG. 5 is a side view of the universal joint tool in a second position supporting an axle in a hydraulic press with portions of the tool and press being broken away to reveal details thereof.

Tool 10 can be used to remove a bearing 56 from a wheel axle 32. To accomplish this, blocks 12*a* and 12*b* are positioned upon base 36 of press 34 with the open rear sides of blocks 12*a* and 12*b* facing one another. Then, bearing 56 is positioned within blocks 12*a* and 12*b* and atop side walls 18 so that axle 32 extends upwardly from blocks 12*a* and 12*b* and wheel support 58 extends downwardly from blocks 12*a* and 12*b* as shown in FIG. 5. Finally, ram 38 of hydraulic press 34 is lowered onto the top of axle 32 to push axle 32 downwardly and slide tight-fitting bearing 56 therefrom. Notches 28 and 30 permit blocks 12*a* and 12*b* to be positioned as closely as possible to one another and to provide optimum support for bearing 56. The process requires only a few minutes to complete.

If the dimensions of wheel support 58 permit, bearing 56 can be positioned atop walls 16 with blocks 12*a* and 12*b* being positioned as shown in FIG. 5. This alternate positioning can better accommodate the dimensions of some hydraulic presses 34. Additionally, walls 18 serve as a stop to the downward movement of wheel axle 32 when bearing 56 becomes detached therefrom.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A universal joint tool, comprising:

a pair of retaining blocks positioned adjacent one another, each of said blocks including:

a front wall having a top, bottom and opposed ends, said front wall also having:

a forward wall segment defining one of the opposed ends of said front wall;

an intermediate wall segment extending rearwardly from said forward wall segment, and;

a rearward wall segment being positioned rearwardly of said forward wall segment and defining the other of the opposed ends of the front wall;

a retaining tab extending forwardly from the bottom of said rearward wall segment;

a top wall extending rearwardly from the top of said front wall;

a bottom wall extending rearwardly from the bottom of said front wall;

said top wall and said bottom wall of each retaining block being provided with notches in registration with one another for accommodating portions of an axle; and, a pair of side walls extending rearwardly from the opposed ends of said front wall and connecting said top wall and said bottom wall together.

* * * * *